US012006814B2

(12) United States Patent
Abalkhail et al.

(10) Patent No.: US 12,006,814 B2
(45) Date of Patent: Jun. 11, 2024

(54) DOWNHOLE COMPLETION ASSEMBLY FOR EXTENDED WELLBORE IMAGING

(71) Applicant: Saudi Arabian Oil Company, Dhahran (SA)

(72) Inventors: Nassir Abdullah Abalkhail, Dhahran (SA); Feras Hamid Rowaihy, Dhahran (SA); Helber Alfonso Forero Reyes, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 977 days.

(21) Appl. No.: 16/941,684

(22) Filed: Jul. 29, 2020

(65) Prior Publication Data

US 2022/0034216 A1 Feb. 3, 2022

(51) Int. Cl.
*E21B 47/002* (2012.01)
*E21B 47/01* (2012.01)

(52) U.S. Cl.
CPC ..... *E21B 47/0025* (2020.05); *E21B 47/01* (2013.01)

(58) Field of Classification Search
CPC ..... E21B 47/0025; E21B 47/01
See application file for complete search history.

(56) References Cited

U.S. PATENT DOCUMENTS 2,842,205 A 7/1958 Allen et al.
4,254,832 A * 3/1981 Patton ..... E21B 33/124 166/147
4,583,592 A 4/1986 Gazda et al.
4,627,496 A 12/1986 Ashford et al.
4,690,214 A 9/1987 Wittrisch
4,715,446 A 12/1987 Wittrisch
(Continued)

FOREIGN PATENT DOCUMENTS

GB 2398805 A * 9/2004 ..... E21B 47/01
RU 86650 U1 9/2009

OTHER PUBLICATIONS

ISRWO dated Nov. 25, 2021, issued for PCT/US2021/043304, 14 pages.

(Continued)

*Primary Examiner* — Jill E Culler
(74) *Attorney, Agent, or Firm* — Bracewell LLP; Constance G. Rhebergen; Keith R. Derrington

(57) ABSTRACT

A wellbore is plugged with a downhole completion assembly configured to permit logging and/or imaging in the wellbore past the completion assembly. The completion assembly includes an annular receptacle with an upper end that is open and a lower end that is closed. The receptacle is mounted inside of a plug that blocks flow around the receptacle while flow through the receptacle is prevented by the closed lower end. The lower end projects deeper into the wellbore past the plug. A space is formed inside the receptacle by its closed lower end and sidewalls, which is accessible by an imaging/logging tool deployed from above and inserted through the open upper end. Imaging or logging from within the receptacle increases how much of the formation around the wellbore that can be imaged/logged. Examples of imaging/logging include nuclear, electro-magnetic, acoustic and for sensing characteristics such as resistivity, density, and porosity.

20 Claims, 6 Drawing Sheets

(56) References Cited

U.S. PATENT DOCUMENTS

| | | | | |
|---|---|---|---|---|
| 5,010,958 | A | 4/1991 | Meek et al. | |
| 5,404,948 | A | 4/1995 | Fletcher | |
| 5,706,896 | A * | 1/1998 | Tubel | E21B 41/00 166/50 |
| 5,799,733 | A | 9/1998 | Ringgenberg et al. | |
| 5,915,476 | A | 6/1999 | Hubbell et al. | |
| 6,279,660 | B1 * | 8/2001 | Hay | E21B 43/14 166/336 |
| 7,140,434 | B2 * | 11/2006 | Chouzenoux | E21B 47/01 166/250.11 |
| 8,132,621 | B2 | 3/2012 | Pettinato et al. | |
| 2015/0068737 | A1 | 3/2015 | Ash et al. | |
| 2015/0090440 | A1 | 4/2015 | Cooke | |

OTHER PUBLICATIONS

Fotuh et al., "Factors That Affect the Success of Mechanical Water Shut-off in Wells", Society of Petroleum Engineers, SPE62891MS, Jan. 1, 2000, 6 pages.

Zubail et al., "Rigless Water Shut-off Experience in Offshore Saudi Arabia", Society of Petroleum Engineers, SPE81443MS, Jan. 1, 2003, 6 pages.

* cited by examiner

DOWNHOLE COMPLETION ASSEMBLY FOR EXTENDED WELLBORE IMAGING

BACKGROUND OF THE INVENTION

1. Field of Invention

The present disclosure relates to a system and method for imaging in a wellbore downhole of a packer or plug that blocks flow in the wellbore.

2. Description of Prior Art

Hydrocarbons are typically produced from subterranean formations via wellbores that are drilled from the Earth's surface and that intersect the formations. The wellbores are generally lined with casing that is cemented to the wellbore walls, and include production tubing inserted into the casing through which the hydrocarbons are conveyed to surface. Often the hydrocarbons deposits are found trapped within a zone of the formation where a discontinuity of rock type or fracture forms an impervious barrier. Generally, the hydrocarbons include an amount of gas and liquid that become stratified inside the zone based on their respective densities; which results in the gas hydrocarbon usually occupying a portion of the zone at a lower depth than the liquid hydrocarbon. When water is present in the zone it typically settles in the lowermost portion of the zone due to its density being greater than the liquid hydrocarbon.

Wellbores generally are constructed to produce fluids from more than one depth in the formation. Usually, these fluids produced from different depths are ultimately mixed together, either inside the production tubing or on surface; and which form a total production flow. Over time some depths become "watered out" and produce mostly water when hydrocarbons are no longer present at these depths. Techniques exist to separate the water from hydrocarbons in the total production flow, which increase cost of production and lower wellbore production. In some instances water influx is addressed by conducting a wellbore intervention that blocks flow downstream or uphole of where water is flowing into the wellbore. The flow is usually blocked by installing a barrier in the wellbore; typical barriers are plugs or packers and sometimes includes injecting an amount of cement in the wellbore. Hardware used to block flow in the wellbore limits the ability to log or image the formation past the barrier.

SUMMARY OF THE INVENTION

Disclosed herein is an example of system for imaging in a wellbore and that includes a downhole completion assembly and an imaging tool. The downhole completion assembly includes a packer in the wellbore that forms a barrier to fluid flowing in the wellbore, and an annular receptacle disposed in the packer having sidewalls and a closed end that is disposed downhole of the packer. The imaging tool is in imaging communication with formation surrounding the wellbore at a depth in the wellbore that is greater than the packer when selectively inserted into the receptacle. In one example, the imaging tool is a downhole device such as a gamma ray logging tool, a resistivity logging tool, or a sonic logging tool. In an example, an end of the receptacle opposite the closed end is an open end, the receptacle further having a scoop head mounted around the open end. Optionally, the system further includes an actuator coupled with the packer and where the packer is deployed by operating the actuator. In an alternative, the downhole completion assembly is disposed in a deviated portion of wellbore, and the imaging tool is deployed on coiled tubing. In one embodiment, production tubing and casing is installed in the wellbore and that each terminate above the packer, hydrocarbons are produced in the wellbore above packer, and the portion of the wellbore below the packer is watered out. An example length of the receptacle is at least a length of the imaging tool.

Another example of a system for imaging in a wellbore is disclosed and that includes a packer assembly deployed in the wellbore and that defines a barrier to fluid flowing axially in the wellbore, and an annular receptacle. In this example the annular receptacle includes sidewalls, a closed lower end at a depth below the packer assembly, an open upper end, and a space inside the receptacle that is defined by the sidewalls and lower end, and that is configured to receive an imaging tool that is in selective imaging communication with a formation surrounding the wellbore at a depth below the packer assembly. A lower portion of the receptacle is selectively detached from an upper portion of the receptacle to define a releasable cap. The system optionally includes a connection that is engaged when the upper and lower portions are attached, and that is disengaged when the upper and lower portions are detached. In one embodiment the system also includes a landing cap that is selectively landed on the receptacle when the imaging tool is received inside the receptacle, and a sealing interface between the receptacle and landing cap defines a barrier to flow between the space and uphole of the packer. In an alternative, an actuator is coupled with the packer, so that when the actuator is selectively initiated the packer is reconfigured between extended and retracted configurations. The packer assembly and receptacle optionally define a downhole completion assembly, where the downhole completion assembly is deployed on a conveyance means, and the downhole completion assembly is selectively moveable downhole in the wellbore when the packer is reconfigured from the extended to the retracted configuration.

Also disclosed is an example of a method of imaging in a wellbore that includes blocking axial flow inside the wellbore with a downhole completion assembly made up of a packer and an annular receptacle having sidewalls that project downhole past the packer, and a closed lower end that spans between the sidewalls. The example method also includes inserting an imaging tool into the receptacle and imaging a formation surrounding the wellbore at a depth below the downhole completion assembly. The method optionally further includes retracting the packer, lowering the downhole completion assembly from a first location in the wellbore, redeploying the packer at a second location in the wellbore that is lower than the first location, and imaging the formation from within the receptacle while the packer is in the second location. The second location alternatively is in a deviated portion of the wellbore. In a example an upper end of the receptacle is open, and the method further involves forming a flow barrier across the upper end, forming an opening in the lower end of the receptacle, lowering the imaging tool to a lower depth that is deeper in the wellbore than the lower end of the receptacle, and imaging inside the wellbore at the lower depth with the imaging tool.

BRIEF DESCRIPTION OF DRAWINGS

Some of the features and benefits of the present invention having been stated, others will become apparent as the description proceeds when taken in conjunction with the accompanying drawings, in which.

Figure 1:
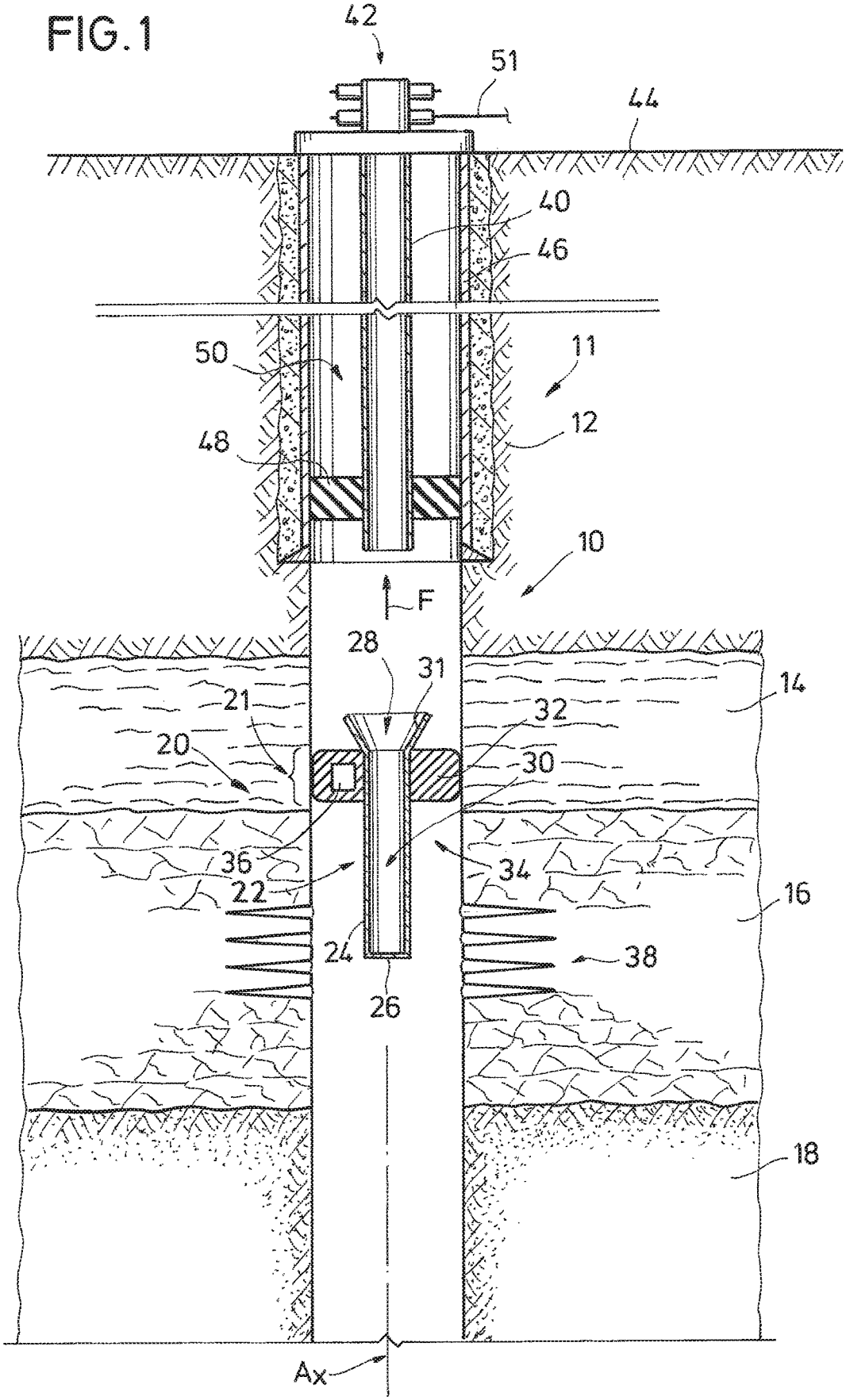
FIG. 1 is a side partial sectional view of an example of a downhole completion assembly installed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side partial sectional view in FIG. 1 is a wellbore 10 that is formed through a subterranean formation 11. Schematically represented in FIG. 1 are a number of sequentially located zones 12, 14, 16, 18 within formation 11 and located at increasingly greater depths. An example of a downhole completion assembly 20 is shown mounted within wellbore 10 and at a first location or depth inside wellbore. Completion assembly 20 includes an annular receptacle 22 with sidewalls 24 that curve about wellbore axis $A_X$. An end wall 26 spans between sidewalls 24 to form a barrier to fluid communication axially through receptacle. An opening 28 is on an end of receptacle 22 opposite from end wall 26, and a space 30 is inside of receptacle 22 that is bounded by sidewalls 24 and end wall 26. Space 30 is accessible through opening 28 from above downhole completion assembly 20. A scoop head 31 is optionally included that is shown disposed adjacent the opening 28. Scoop head 31 is a funnel-like element with frusto-conically shaped sidewalls that terminate above opening 28 and define an entry with an area greater than opening 28, and which facilitates entry into opening 28 and insertion into space 30. A packer 32 is also included with completion assembly 20 that is shown circumscribing receptacle 22 and substantially occupying annulus 34 between receptacle 22 and sidewalls of wellbore 10. Sealing interfaces are formed between an inner radius of packer 32 and outer surface of sidewalls 24 and along an outer radius of packer 32 and sidewalls of wellbore 10. The combination of the packer 32 and receptacle 22 block flow within wellbore 10 and along axis $A_x$. An optional actuator 36 is schematically illustrated with packer 32 that when selectively initiated expands packer 32 between retracted and extended configurations; in FIG. 1 packer 32 is shown in an extended configuration. Described in more detail below, when in a retracted configuration packer 32 is spaced radially inward from sidewalls of wellbore 10 which enables moving completion assembly 20 to different depths within wellbore 10. In the example of FIG. 1, perforations 34 projecting radially outward from wellbore into formation 11, and which form conduits for fluid flow into wellbore 10 from zone 16 of formation 11.

One function of downhole completion assembly 20 in the wellbore 20 includes isolating fluids produced in a portion of wellbore 10 from fluids produced in another portion or portions of the wellbore 10, and isolating to prevent fluid from inside the wellbore from flowing into aquifers or other large subterranean bodies of water. The fluids being isolated in this example are referred to as fluids not designated for production, examples of which include water, fluids having a percentage of water above a designated threshold level. In an alternative, criteria for classifying particular fluids as not designated for production or those that are designated for production include an evaluation of the economics involved in producing the particular fluids. In the example of FIG. 1 downhole completion assembly 20 is installed in wellbore 10 to block fluids being produced from formation 11 into the wellbore 10 at depths greater than or downhole of packer 32; which as shown in FIG. 1 includes zones 16 and 18 and a portion of zone 14. In one embodiment of this example, the fluids being blocked contain mostly water; either as a result of hydrocarbon depletion in the reservoirs (not shown) at depths below the first location 21 and being watered out, or these reservoirs naturally having a high water content. Further in this example, the first location 21 at which completion assembly 20 is deployed is strategically selected to be above or uphole of watered out or water producing zones (i.e. zones 16, 18 and a portion of formation 14). The strategic positioning of first location 21 puts downhole completion assembly 20 below depths in the wellbore 10 where hydrocarbon fluids F enter wellbore 10 from the surrounding formation; which as shown includes portions of zones 12 and 14. In the example of FIG. 1, the first location 21 is selected at a lesser depth (or above) from where fluids that enter wellbore 10 are not designated for production, and at a greater depth (or below) where fluids that enter the wellbore 10 are designated for production.

Fluid F is shown flowing uphole within wellbore 10 and into an entrance on a lower end of a string of production tubing 40, an upper end of the production tubing 40 connects to a wellhead assembly 42 shown mounted on surface 44 and above an opening of wellbore 10. Packers 48 fill an annulus 50 between production tubing 40 and sidewalls of wellbore 10, and which direct fluid F to inside of the production tubing 40. Casing 46 is shown lining a portion of the wellbore 10 and which terminates at a depth uphole of first location 21 where completion assembly 20 is installed. A production line 51 is shown attached to wellhead assembly 42 outside of wellbore 10, and in which fluids F produced from within wellbore 10 are selectively transported away from the well site for refinement, processing, or collection.

Figure 2:
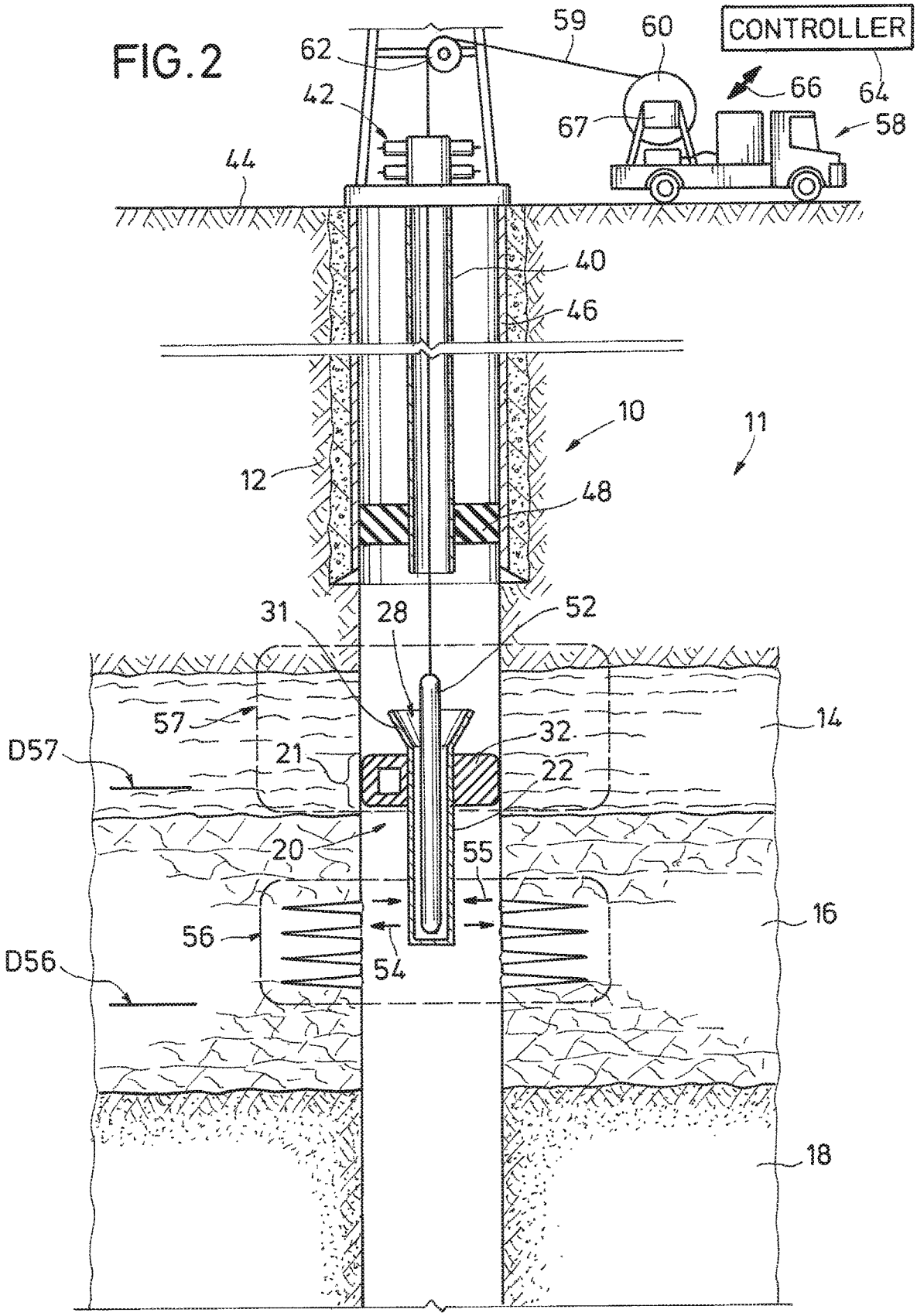
FIG. 2 is a side partial sectional view of an example of an imaging tool landed in the downhole completion assembly of FIG. 1.

Shown in a side partial sectional view in FIG. 2 is an example of imaging/logging formation 11 from within wellbore 10 using a logging/imaging tool 52. Examples exist of logging/imaging the formation 11 at a point in time ranging from hours to years after the downhole completion assembly 20 is installed in the wellbore 10. In the example of FIG. 2, imaging tool 52 is deployed within wellbore 10 and inserted into the space 30 within receptacle 22. The imaging tool 52 as shown extends substantially along the length of space 30 so that a lower end of tool 52 is adjacent the end wall 26 of receptacle 22. An example of logging/imaging the formation 11 with the tool 52 is shown in which energy 54 (schematically illustrated as an arrow) emanates from the imaging tool 52 and travels within the formation 11 at depths below and past the first location 21 and packer 32. Further in this example, interaction between the energy 54 and formation 11 generates feedback 55 (also schematically represented as an arrow) that is received and or sensed by the imaging tool 52. The feedback 55 is optionally analyzed to obtain information about and/or characterize the formation 11. An imaged section 56 shown in dashed outline represents a portion of formation 11 irradiated by the energy 54 and/or feedback 55. Alternatively, imaged section 56 includes a portion of the formation 11 characterized or capable of being characterized by the imaging tool 52 from within the receptacle 22. An example of an imaged section 57 is also provided in the example of FIG. 2 that represents the portion of formation 11 irradiated or capable of being characterized by imaging tool 52 when a conventional plug or packer is set at the first depth 21. For the purposes of illustration herein, a lowermost or deepest portion of imaged section 56 is shown at a depth $D_{56}$; and a lowermost or deepest portion of imaged section is shown at a depth of $D_{57}$, which is above or at a lesser depth than depth $D_{56}$ in the formation 11. In one example of use of the downhole completion tool 20, the formation 11 is imaged at depths between imaged sections 56, 57; illustrating that implementation of the downhole completion assembly 20 enables imaging within a greater percentage of the wellbore 10 over that of a conventional plug; and that in turn enables characterization of a corresponding greater percentage of the formation 11. Example lengths of the receptacle 22 range from about 50 feet to about 350 feet and include all distances between 50 feet and 350 feet.

Embodiments of the imaging tool 52 include anything employed to gather information about a subterranean formation, and specific examples of the imaging tool 52 include tools, assemblies, systems, or processes deployed or conducted within a wellbore to obtain the formation information. In an example, the energy 54 is in the form of electricity directed into the formation 11, and the feedback 55 includes a response to the electricity in the formation 11. Examples of energy 54 in the form of electricity include current, an electrical field, a magnetic field, an electromagnetic signal, combinations, and the like; and examples of the resulting feedback 55 include any measurement or response resulting from the formation 11 being exposed to electricity. Alternatives of the energy 54 include an acoustic signals, such as compressional waves, shear waves, Lamb waves, Rayleigh waves, and the like; in which examples of the feedback 55 include information about a reflection of the acoustic signal from the formation 11. Radiation, such as gamma rays from a source include another alternative form of energy 54, and an example of a corresponding feedback 55 includes scatter of the radiation.

Still referring to FIG. 2, an example of a service truck 58 is shown on surface 44, and which is coupled to imaging tool 52 via a line 59. Examples of the line 59 include wire line, slick line, cable, coiled tubing, and jointed pipe. Line 59 of FIG. 2 is shown spooled on a reel 60 that mounts on truck 58, line 59 drawn from the reel 60 is directed into the wellhead assembly 42 over a sheave 62 shown mounted above the wellhead assembly 42. An end of line 59 opposite reel 60 attaches to imaging tool 52. The feedback 55 sensed by imaging tool 52 is optionally communicated uphole via line 59, such as in the form of data. In an alternative truck 58 and tool 52 are in communication through line 59, in which examples of communication include the data. In an alternative, one or more of the embodiments of line 59 is used for installed completion assembly 20 in the wellbore 10. A running tool (not shown) is optionally used for attaching completion assembly 20 to line 59. When lowered to a designated depth in the wellbore 10, such as first location 21, packer 32 is deployed to form a barrier to flow through annulus 34 and past the downhole completion assembly 20. An optional controller 64 is schematically shown in communication with truck 58 via communication means 66. Examples of the controller 64 include any device having electronics such as a processor, memory accessible by the processor, nonvolatile storage area accessible by the processor, and logics for performing steps, such as for selectively providing operational commands for tool 52. Controller 64 further optionally includes media or a means of storing information collected by tool 52 while in wellbore 10. Further optionally, processor included with controller 64 analyzes and processes data, such as putting the data provided by tool 52 into readable and visual format. Examples of the communication means 66 include devices for transmitting and receiving wireless signals and mediums for transmitting signals, such as signal conducting lines and fiber optic lines; also included are ways of compiling and decompiling signals. A motor 67 is schematically illustrated that is coupled with reel 60 and that when energized selectively rotates reel 60 to lower the line 59 in the wellbore 10 such as when deploying the imaging tool 52 in the wellbore 10 and lowering it into the receptacle 22. Conversely, the imaging tool 52 is drawn upward from receptacle 22 and/or from the wellbore 10 by operating motor 67 in a reverse direction. On completion of a logging/imaging operation, imaging tool 52 is removed from the wellbore 10 by drawing line 59 out of the wellbore 10, in this example the downhole completion assembly 20 remains installed in the wellbore 10.

Figure 3:
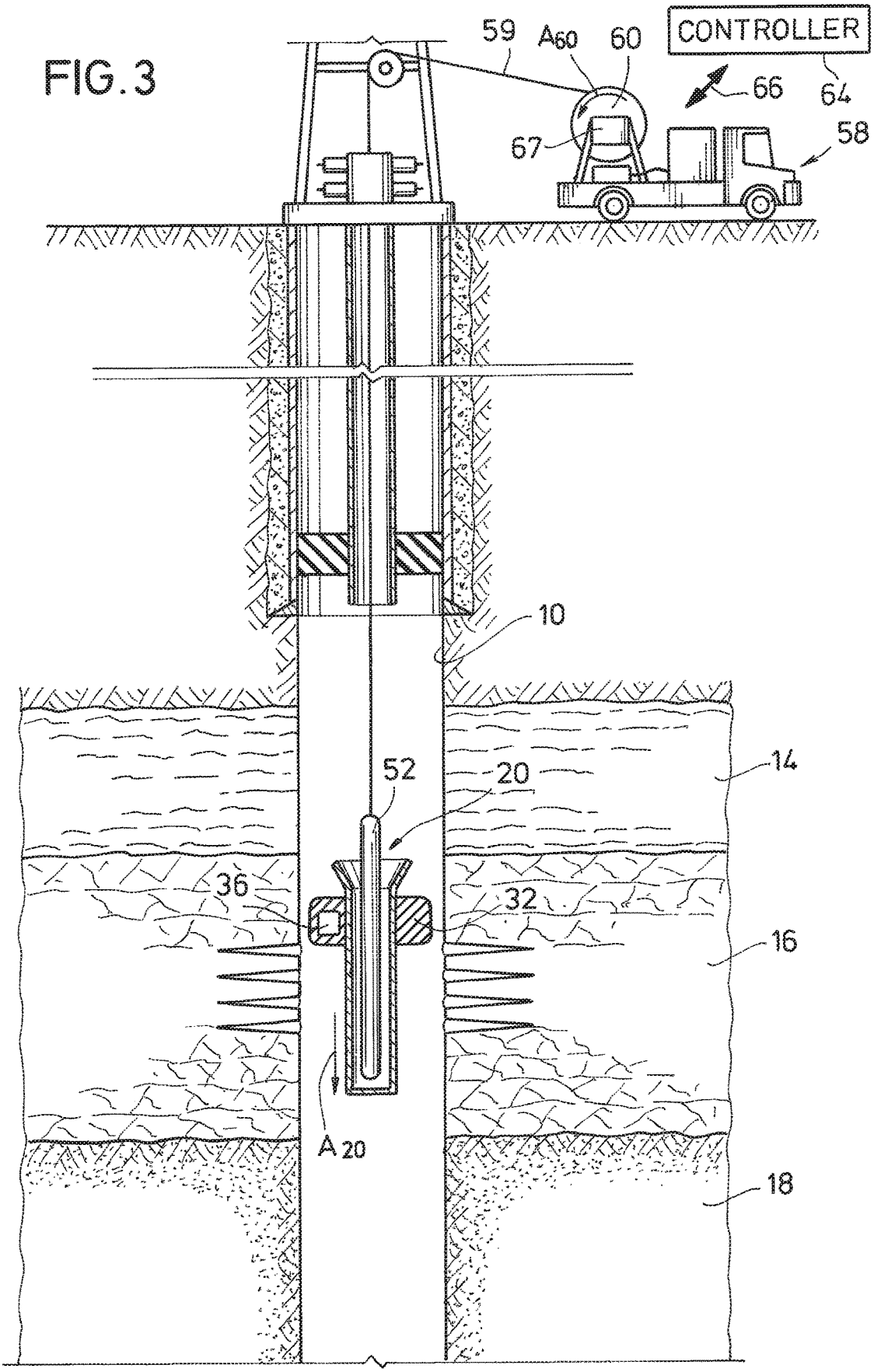
FIGS. 3 and 4 are side partial sectional views of an example of operating an alternate example of the downhole completion assembly of FIG. 1.

Shown in FIG. 3 is a side partial sectional view of an alternate example of imaging within wellbore 10 where actuator 36 is selectively initiated to reconfigure packer 32 from its extended configuration of FIG. 1 and into a retracted configuration. As noted above, in a retracted configuration the packer 32 is spaced radially inward from sidewalls of wellbore 10 and moveable within wellbore 10. In the example shown, motor 67 is energized and is rotating reel 60 in a direction represented by arrow $A_{60}$ that in turn lowers completion assembly 20 farther downhole on line 59 in the direction of arrow $A_{20}$. In this example downhole tool 52 and/or actuator 36 is in communication with truck 58 and/or controller 64 as the downhole completion assembly 20 is being moved downhole.

Figure 4:
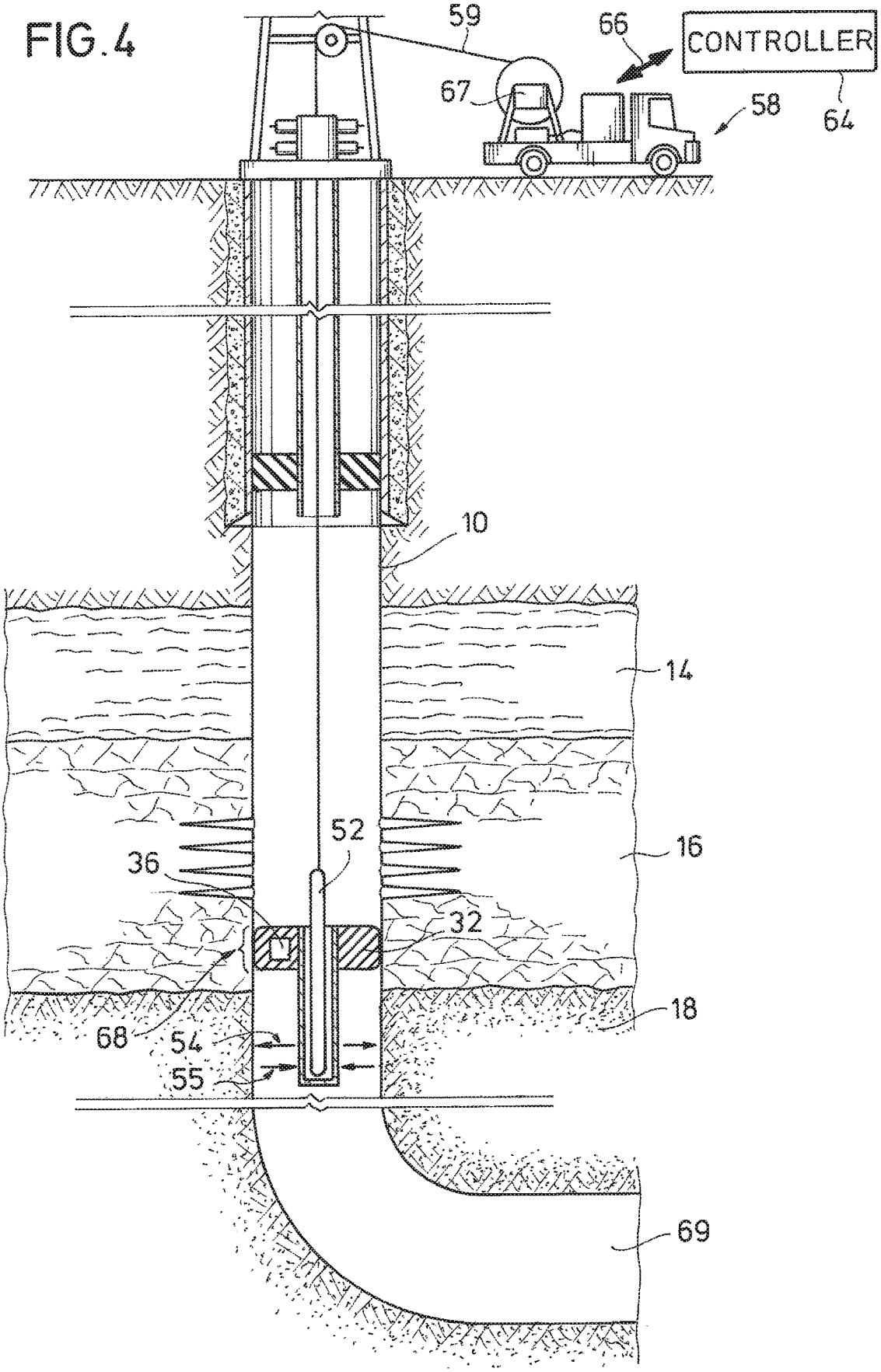

Illustrated in FIG. 4 is a subsequent example step of the alternate example of FIG. 3. Shown is that the downhole completion assembly 20 and imaging tool have been lowered to a designated depth, referred to herein as a second location 68. Examples exist in which one or each of the first location 21 (FIG. 1) and second location 68 are at a specific depth in the wellbore 10 or a range of depths in the wellbore 10. In the example of FIG. 4, after the completion assembly 10 and imaging tool 52 are lowered to the second location 68, the packer 32 is reconfigured into the extended configuration to form a barrier to flow axially within wellbore 10 at the second location 68. Upon redeployment of the packer 34 within wellbore 10, energy 54 is selectively emitted from imaging tool 52 into the surrounding formation 11. An analysis of feedback 55 received by imaging tool 52 provides information about formation 11 within zone 18. It should be pointed out that depending on the type of imaging tool used in the wellbore 10, formations above and below tool 52 are selectively imaged. In one alternative packer 32 is retracted and completion assembly 20 and tool 52 are lowered into a deviated section 69 of wellbore 10 shown at a location deeper than second location 68.

Figure 6:
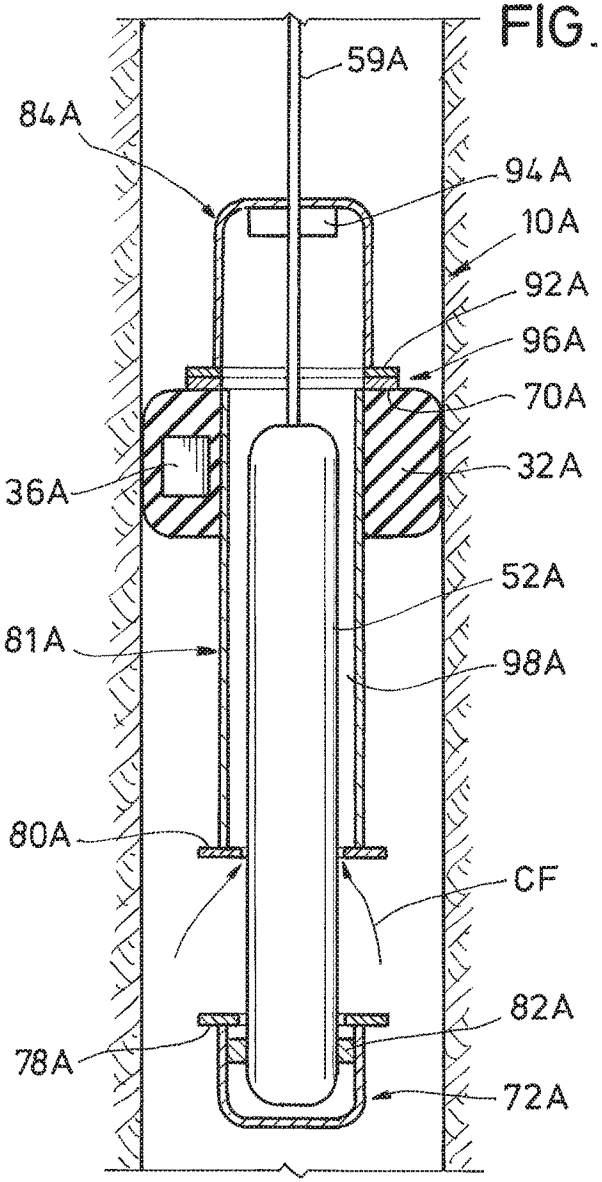
FIGS. 5, 6, and 7 are side partial sectional views of an example of operating another alternate example of the downhole completion assembly of FIG. 1.
Figure 5:
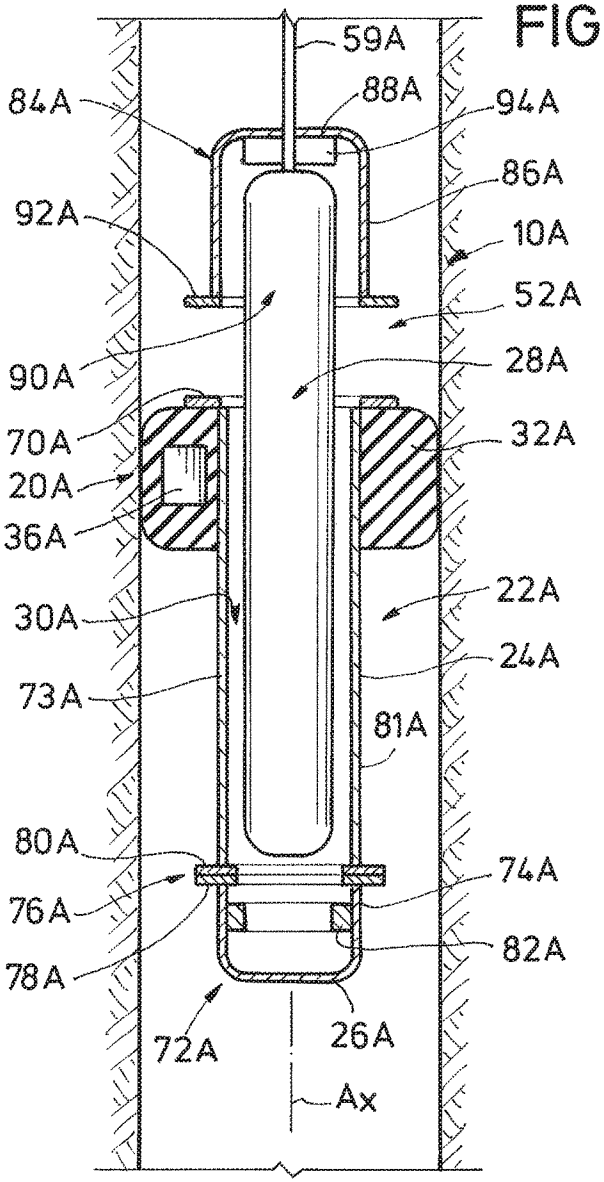

Shown in side section view in FIGS. 5 and 6 is another alternative example of operation and where an alternate example of the downhole completion assembly 20A is shown anchored within wellbore 10A with packer 32A in an extended configuration to form a sealing interface with sidewalls of wellbore 10A. In this example, a ring-like flange 70A is shown circumscribing the opening 28A of receptacle 22A, which as described in more detail below selectively forms a sealing interface to block fluid communication axially from within space 30A. Also included with receptacle 22A is a releasable cap 72A shown having an end wall 26A that spans sidewalls 74A of the releasable cap 76A and on a side or end distal from the opening 28A. A connection 76A shown on an upper end of sidewalls 74A which includes a releasable cap latch 78A that selectively mates with a receptacle latch 80. Receptacle latch 80 is on a lower terminal end of sidewalls 24A of an upper portion 81A of the receptacle 22A. A number of latching configurations between latches 78A, 80A are envisioned and are within the capabilities of one skilled. For example, latching means include mechanical latches, which has dogs that insert into recesses, as well as electromagnetic latches that form a magnetic bond when selectively energized. An optional coupler 82A is shown formed on an inner surface of sidewall 74A and as described below, provides a coupling means for engaging lower cap 72A with imaging tool 52A. In the example of FIG. 5 also included is a landing cap 84A configured to land on an upper end of receptacle 22A. Landing cap 84A of FIG. 5 has curved sidewalls 86A that circumscribe axis $A_x$, and an end wall 88A that spans between sidewalls 86A; the combination of the sidewalls 86A and end wall 88A form a barrier to fluid flow. A space bounded by sidewalls 86A and end wall 88A is accessible through an opening 90A disposed opposite from end wall 88A. A ring-like cap flange 92A is shown on a lower terminal end of sidewalls 86A and projecting radially outward. A union 94A is schematically shown on an inner surface of end wall 88A and that provides a releasable coupling between the cap 84A and tool 52A. Line 59A projects axially through the cap 84A and union 94A and is coupled to tool 52A. In the example of FIG. 5, landing cap 84A is coupled onto imaging tool 52A, and both are deployed in wellbore 10A on line 59A and are being lowered into receptacle 22A.

Referring to FIG. 6, shown is an example of an operational step subsequent to that of FIG. 5 and that shows cap 84A landed on receptacle 22A. In the example shown cap 84A is positioned so that the cap flange 92A lands on receptacle flange 70A to form a sealing interface. Example materials for one or both of the flanges 70A, 92A include elastomers or metal. In one example, opposing surfaces of the flanges 70A, 92A are finished smooth so that when engaged a flow resistant interface is formed. Optionally, opposing surfaces of one or both flanges 70A, 92A are profiled, such as with a protrusion and complementary recess, that when the protrusion inserts into the recess a sealing interface is formed. Further in this example line 59A is movable through cap 84A to allow line 59A to pass through cap 84A and lower imaging tool 52A farther downhole after cap 84A lands on receptacle flange 70A. Also in the example of FIG. 6, connection 76A is decoupled allowing the attachment of latches 78A, 80A and so that tool 52A is free to be lowered farther downhole within wellbore 10A and past the upper portion 81A. Further shown is that cap 72A and tool 52A are engaged by coupler 82A while tool 52A is lowered past a lower end of upper portion 81A.

Figure 7:
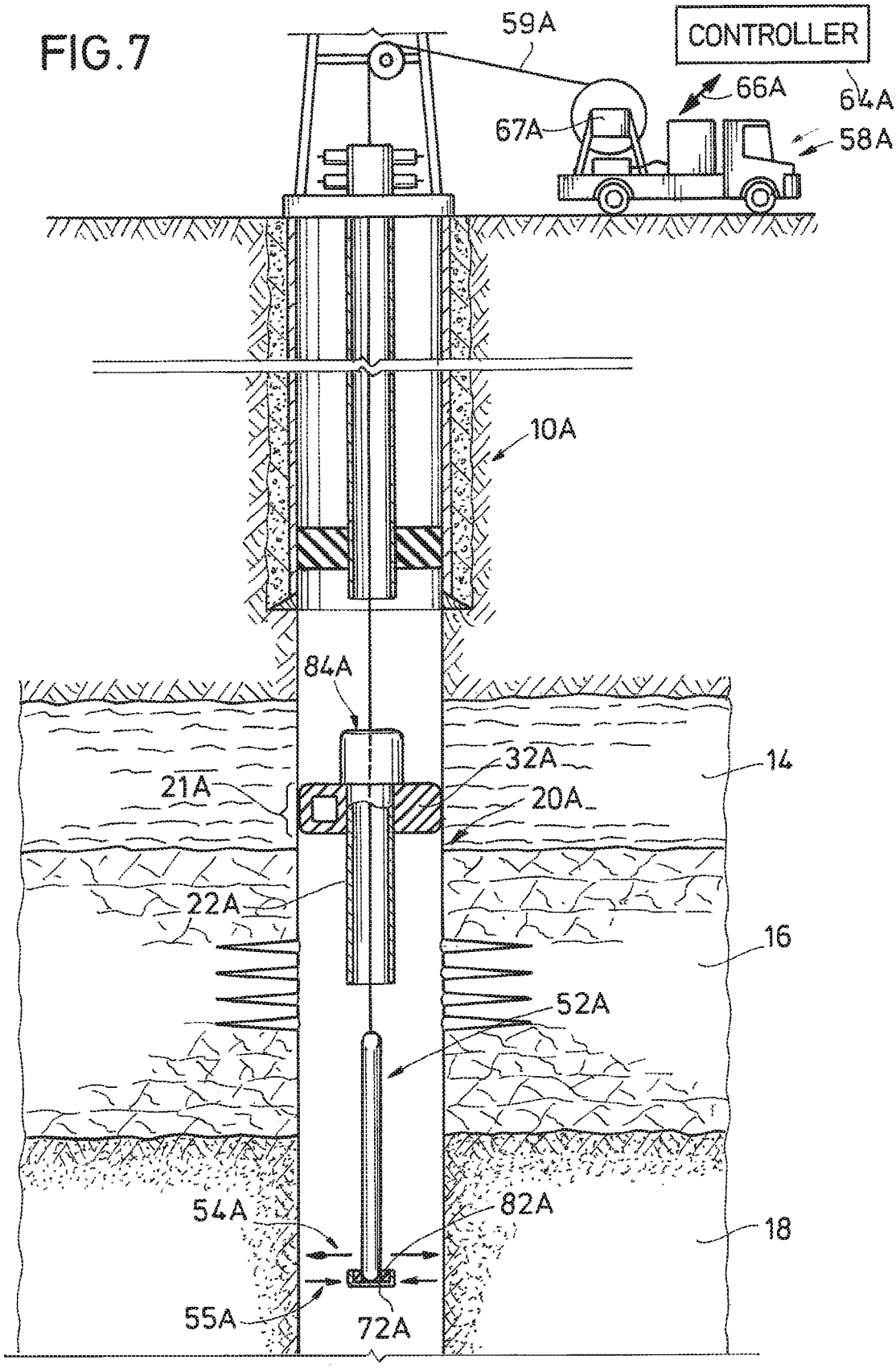

Illustrated in the example of FIG. 7 is a subsequent step of the example operation depicting the tool 52A imaging at depths below the first location and outside of the receptacle 22A; and with cap 72A being engaged to tool 52A with the coupler 82A while imaging deeper in the wellbore 10A than first location 21A. The presence of cap 84A blocks the flow fluid within wellbore 10A from flowing axially past the completion assembly 20A. Similar to the example of FIG. 2, surface truck 58A provides communication downhole to tool 52A and controller 64A and communication means 66A facilitate collection of data recorded or collected by tool 52A. Further selective operation of motor 64A in this example provides the selective raising and lowering of tool 52A within wellbore 10A.

For the purposes of discussion herein, spatial terms such as above, uphole, shallower, or lesser depth refers to a location or locations in the wellbore 10 closer to surface 44 than a referenced location; conversely, spatial terms such as below, deeper, downhole, or greater depth refers to a location or locations in a direction farther away from surface 44 than the referenced location.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for imaging in a wellbore comprising:

a downhole completion assembly that comprises, a packer in the wellbore that forms a barrier to fluid flowing in the wellbore and isolates zones above and below the packer from one another, and an annular receptacle disposed in the packer having sidewalls and a closed end that is disposed downhole of the packer; and an imaging tool that is selectively inserted inside the receptacle, so that when a lower end of the imaging tool is adjacent the closed end and downhole of the packer, the imaging tool is in imaging communication with formation surrounding the wellbore at a depth in the wellbore that is greater than the packer when selectively inserted into the receptacle.

2. The system of claim 1, wherein the imaging tool comprises a downhole device selected from the group consisting of a gamma ray logging tool, a resistivity logging tool, a sonic logging tool, and combinations thereof.

3. The system of claim 1, wherein an end of the receptacle opposite the closed end comprises an open end, the receptacle further comprising a funnel-like scoop head with frustro-conically shaped sidewalls mounted around the open end, the scoop head defining an entry with an area greater than the open end and which facilitates entry of the imaging tool into the receptacle.

4. The system of claim 1, further comprising an actuator coupled with the packer and wherein the packer is deployed by operating the actuator.

5. The system of claim 1, wherein the downhole completion assembly is disposed in a deviated portion of wellbore, and the imaging tool is deployed on coiled tubing.

6. The system of claim 1, wherein the imaging tool is moveable with respect the sidewalls of the receptable when the packer is set in the wellbore.

7. The system of claim 1, wherein a length of the receptacle is at least a length of the imaging tool.

8. A system for imaging in a wellbore comprising:

a packer assembly deployed in the wellbore and that defines a barrier to fluid flowing axially in the wellbore; and an annular receptacle coupled with the packer and having sidewalls, a closed lower end at a depth below the packer assembly, an open upper end, and a space inside the receptacle that is defined by the sidewalls and lower end, and that is configured to receive an imaging tool having a lower end that when the imaging tool is inserted into the space downhole of the packer, and the imaging tool is in selective imaging communication with a formation surrounding the wellbore at a depth below the packer assembly.

9. The system of claim 8, wherein a lower portion of the receptacle is selectively detached from an upper portion of the receptacle to define a releasable cap.

10. The system of claim 9, further comprising a connection that is engaged when the upper and lower portions are attached, and disengaged when the upper and lower portions are detached.

11. The system of claim 9, further comprising a landing cap that is selectively landed on the receptacle when the imaging tool is received inside the receptacle, and a sealing interface between the receptacle and landing cap defines a barrier to flow between the space and uphole of the packer.

12. The system of claim 8, further comprising an actuator coupled with the packer, so that when the actuator is selectively initiated the packer is reconfigured between extended and retracted configurations.

13. The system of claim 12, wherein the packer assembly and receptacle define a downhole completion assembly, wherein the downhole completion assembly is deployed on a conveyance means, and the downhole completion assembly is selectively moveable downhole in the wellbore when the packer is reconfigured from the extended to the retracted configuration.

14. A method of imaging in a wellbore comprising:

blocking axial flow inside the wellbore with a downhole completion assembly that comprises a packer and an annular receptacle coupled with the packer, the receptacle having sidewalls that project downhole past the packer, and a closed lower end that spans between the sidewalls;

while the completion assembly is blocking axial flow inside the wellbore inserting an imaging tool into the receptacle so that a lower end of the imaging tool is adjacent the closed lower end; and imaging a formation surrounding the wellbore at a depth below the downhole completion assembly.

15. The method of claim 10, further comprising retracting the packer, lowering the downhole completion assembly from a first location in the wellbore, redeploying the packer at a second location in the wellbore that is lower than the first location, and imaging the formation from within the receptacle while the packer is in the second location.

16. The method of claim 15, wherein the second location is in a deviated portion of the wellbore.

17. The method of claim 14, wherein an upper end of the receptacle is open, the method further comprising forming a flow barrier across the upper end, forming an opening in the lower end of the receptacle, lowering the imaging tool to a lower depth that is deeper in the wellbore than the lower end of the receptacle, and imaging inside the wellbore at the lower depth with the imaging tool.

18. The method of claim 14, wherein the imaging tool is inserted into the receptacle at point in time that is at least hours after the completion assembly begins blocking axial flow inside the wellbore.

19. The method of claim 14, wherein the completion assembly is strategically installed at a designated depth in the wellbore that is between a watered out zone and a hydrocarbon producing zone.

20. The method of claim 14, wherein while imaging the formation, the imaging tool is moveable with respect to the sidewalls.

* * * * *